United States Patent [19]

Janusch

[11] Patent Number: 4,502,227

[45] Date of Patent: Mar. 5, 1985

[54] PROCESS FOR CONTINUOUSLY DRYING AND UPGRADING OF ORGANIC SOLID MATERIALS SUCH AS, FOR EXAMPLE, BROWN COALS

[75] Inventor: Alois Janusch, Leoben, Austria

[73] Assignee: Voest-Alpine Aktiengesellschaft, Vienna, Austria

[21] Appl. No.: 457,621

[22] Filed: Jan. 13, 1983

[30] Foreign Application Priority Data

Jan. 20, 1982 [AT] Austria ..... 192/82

[51] Int. Cl.[3] ..... F26B 7/00; F26B 5/04

[52] U.S. Cl. ..... 34/12; 34/15; 201/41

[58] Field of Search ..... 44/10 J; 34/12, 15; 201/41

[56] References Cited

U.S. PATENT DOCUMENTS 3,992,784 11/1976 Verschuur et al. ..... 34/12

4,369,094 1/1983 Flockenhaus et al. ..... 201/41

*Primary Examiner*—John J. Camby

*Attorney, Agent, or Firm*—Cushman, Darby & Cushman

[57] ABSTRACT

For drying organic solid materials such as, for example, brown coals, these materials are, after preheating, treated with saturated steam under a pressure of 5 to 45 bar and at a temperature of 150° to 260° C. Prior to the subsequent upgrading step, the water content can further be reduced by introducing superheated steam and/or a pressure relief, whereupon immediately subsequently an upgrading treatment, particularly a gasification under pressure, a briquetting or a coal liquification, is effected with the sensible or intrinsic heat from the drying stage. Preferably the dried organic solid materials are introduced into the upgrading stage while still being under a residual pressure of the drying stage.

5 Claims, 2 Drawing Figures

Figure 1:
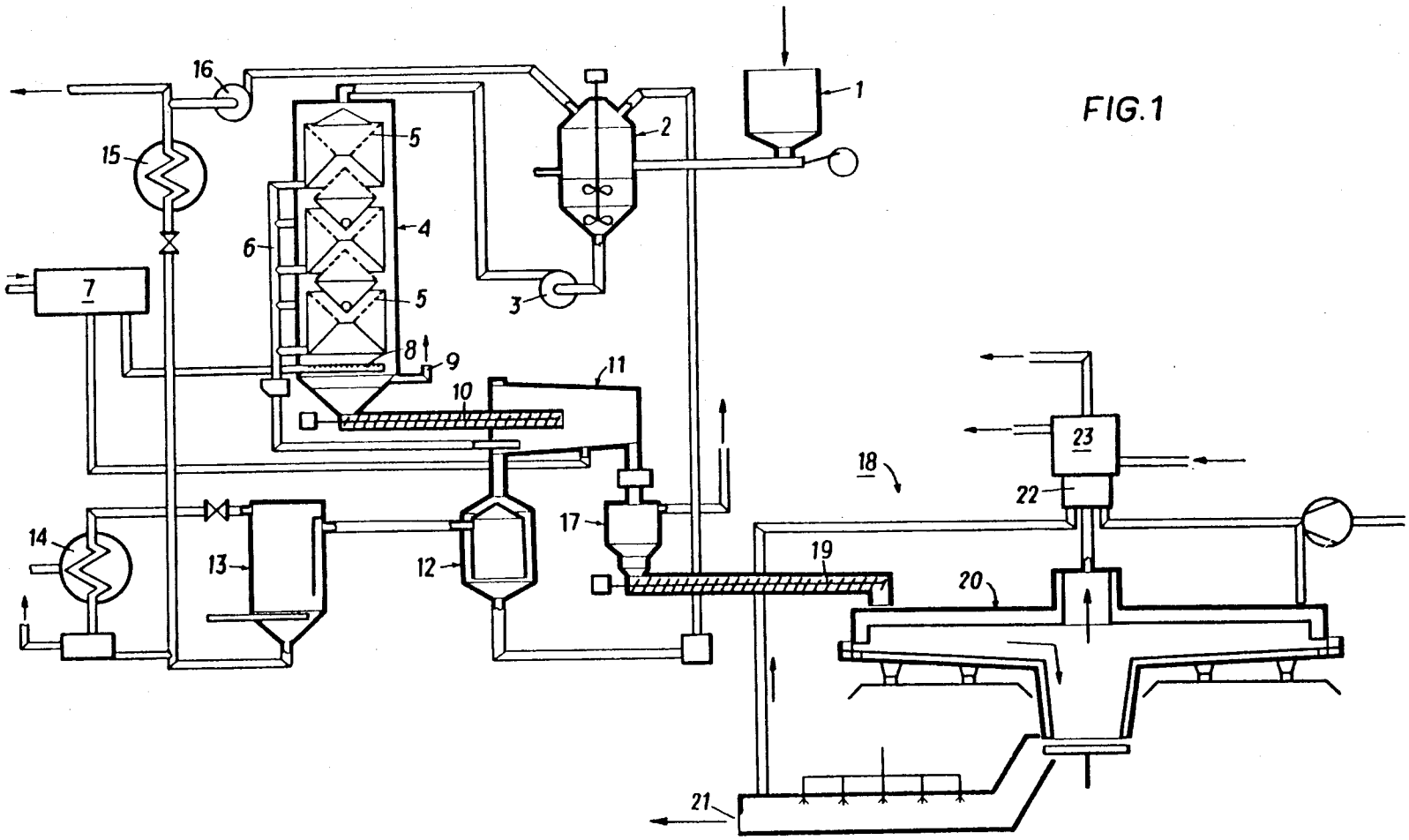

PROCESS FOR CONTINUOUSLY DRYING AND UPGRADING OF ORGANIC SOLID MATERIALS SUCH AS, FOR EXAMPLE, BROWN COALS

The invention refers to a process for continuously drying and upgrading organic solid materials such as, for example, brown coals, in which, after preheating the solid materials, saturated steam is contacted with the solid materials under continuous removal of the expelled and condensating water and of the $CO_2$ formed and under a pressure of 5 to 45 bar and at temperatures of 150° to 260° C., whereupon a drying step is optionally effected by means of superheated steam and/or a pressure release step is optionally effected.

When processing brown coals of high water content, which can have a water content up to 65%, to marketable fuels (lumpy fuel, briquets), gas, coke or, by liquification, motor fuel, lubrificants, the brown coal must be dried. The brown coal obtained by drying must, in dependence on its further use, have a water content of 0 to at most 35%. Dry coal to be gasified within a stationary bed gasifier has an allowed maximum humidity content of 35%, whereas the admissible humidity content for the gasification within a fluidized bed or flying dust cloud is 0 to 15%, and the requested humdity contents are 15% for coal to be coked and 5 to 10% for coal to be liquified.

For drying brown coals of high water content, substantially three types of drying processes proved suitable. These types of processes are drying within drying drums for grain sizes of 0 to 25 mm and preferably 0 to 8 mm, drying with steam according to Flei ner for grain sizes of 20 to 150 mm and fluidized bed drying for grain sizes of 0 to 5 mm.

It is a drawback of the known drying process according to Flei ner, such as for example described in AT-PS No. 190 490 and in AT-PS No. 185 349, that this process operates discontinuously. Modifications of this basic drying process performed with saturated steam are known from AT-PS No. 363 905 and AT-PS No. 363 906 according to which the process is continuously performed. The continuous process has, as compared with the older discontinuous process, the advantage that the desired properties of the end product of the drying process can substantially more exactly be controlled and that furthermore products of improved properties can be obtained as compared with the discontinuous types of operation. Control and maintainance of defined properties of the product are of particular importance above all when considering any subsequent upgrading of the end product.

From the DE-OS No. 29 35 594 there is already known a process according to which subsequently to drying effected in a plurality of autoclaves, gas removal and gasification was effected under pressure. A certain improvement could be obtained with this process when considering the energy balance, particularly when considering the better utilization of the heat of the dried brown coal particles after having same removed from the discontinuously operated drying step. On account of this known process being discontinuously operated, this process is more expensive in operation as well as in the required equipment, because a plurality of steam receptacles must be provided to be in the position to effect the drying cycle required for drying the coal with steam at least with respect to preheating the coal and with respect to steaming same under pressure. This discontinuous operation also results, on account of the difficult coordination of the capacity of the coal drying step and of the gasifying reactor, in drawbacks for the operations to be effected within the gasifying reactor to which dry coal of varying quality must be supplied.

It is an object of the invention to make use of the advantages resulting with respect to the homogeneity and the constancy of the properties of the dried product for upgrading purposes. For solving this task, the invention essentially consists in that the solid materials are, immediately after treatment with saturated steam or, respectively, drying, continuously introduced with their sensible or intrinsic heat into the upgrading stage. The continuous drying process operated with steam is performed on brown coal having a particle size within the range of 0 to 60 mm, preferably within the range of 0 to 10 mm, 5 to 20 mm, or the like, as applies for fine coals, so that a particularly homogeneous product of constant properties is obtained which immediately can be supplied to the upgrading stage. In the upgrading stage there can be used, above all, further processing steps such as a gasification, gasification under pressure, coking, hydrogenation, liquification or briquetting, which result, in view of the drying process being continuously operated, in an improvement of the energy balance by utilizing the residual heat and additional advantages. In particular, the drying process can, with a continuously operated drying process, be controlled such that the dried product is given the desired humidity content and also the desired degree of carbonization, i.e. by degrading carboxy groups and oxygen-containing carbon compounds. The continuous process greatly facilitates collecting and removal of the water expelled from the coal and obtained as a condensate of steam during the drying step, which water can as well as the generated $CO_2$ be extracted at suitable locations, so that there results, in addition to an improvement of the heat balance of the drying process, also the advantage that the properties of the material; such as for example the plasticity of the dried coal and the distribution of binding agents contained within the coal, are influenced in a particularly favourable manner. Simultaneously, substantially smaller drying aggregates are sufficient for a given production capacity of the subsequent upgrading process. The waste heat or residual heat of the drying stage can be utilized within the subsequent upgrading process.

In a particularly advantageous manner, the continuous operation not only provides the possibility to further process the final product of the drying stage with its sensible heat but also the possibility to further process this final product at the same pressure level as is used in the last drying stage. This is of particular importance for a briquetting step. If, for example, a centrifuging step is performed within the last drying stage under pressure and in presence of superheated steam, the dried product can be homogenized and then further processed in some sort of activated condition in which the plastic properties of the coal, observable at certain temperatures and pressures, can advantageously be used. Such a centrifuging step additionally provides for a subsequent briquetting step the advantage that the proportion of binding agent contained in the coal is accumulated at the surface of the coal particles under the action of the centrifugal force and, if no complete pressure release is effected, the somehow activated condition and the plastic condition of the dried particles can be utilized immediately in the following process step.

For this purpose the invention preferably contemplates that the organic solid materials are removed from the last drying stage under super-atmospheric pressure and introduced into the subsequent upgrading stage. In such a case, the pressure within the last drying stage can preferably be selected equal to the pressure or higher than the pressure prevailing within the upgrading stage. Particularly with a gasification under pressure and with a coal liquification one can now do without again pressurizing the coal and one can further operate immediately with the pressure prevailing within the last drying stage.

With drying with saturated steam, as corresponding to the principle of the process according to Fleißner, only an equilibrium humidity content can be obtained in dependence on the humidity content of the processed organic solid materials. For a gasification, these humidity content values can, without further, already have the required value. With brown coals of lower water content, the humidity content required for coking can, under circumstances, even be obtained by drying with saturated steam alone. For the purpose of gasification and coal liquification, a drying stage operated with superheated steam will, as a rule, be required for further drying and it is just such a drying stage operated with hot steam which provides for an ample latitude for selecting the pressure within the drying stage operated with hot steam as well as for selecting a suitable temperature. As compared thereto, the economically reasonably applicable values of pressure and temperature within the drying stage operated with saturated steam are substantially limited by the condition that a saturated steam atmosphere shall be present. It is therefore without further possible to exactly adapt a subsequent drying stage operated with hot steam in a continuously operated process to the special process conditions of a subsequent upgrading stage. In this case the mode of operation is preferably such that the organic solid materials are continuously partially pressure-relieved between the last drying stage and charging same into the upgrading stage if they are removed at a pressure higher than that prevailing in the upgrading stage, the pressure at charging into the upgrading stage preferably being equal to the pressure within the upgrading stage.

For coking purposes it is, as a rule, necessary to reduce the pressure down to atmospheric pressure, but also in this case better possibilities of adapting the dried material to be continuously supplied into the coking stage to the coking conditions are obtained with a continuously operated process.

In the following, the invention is further illustrated with reference to the drawing schematically showing embodiments.

Figure 2:
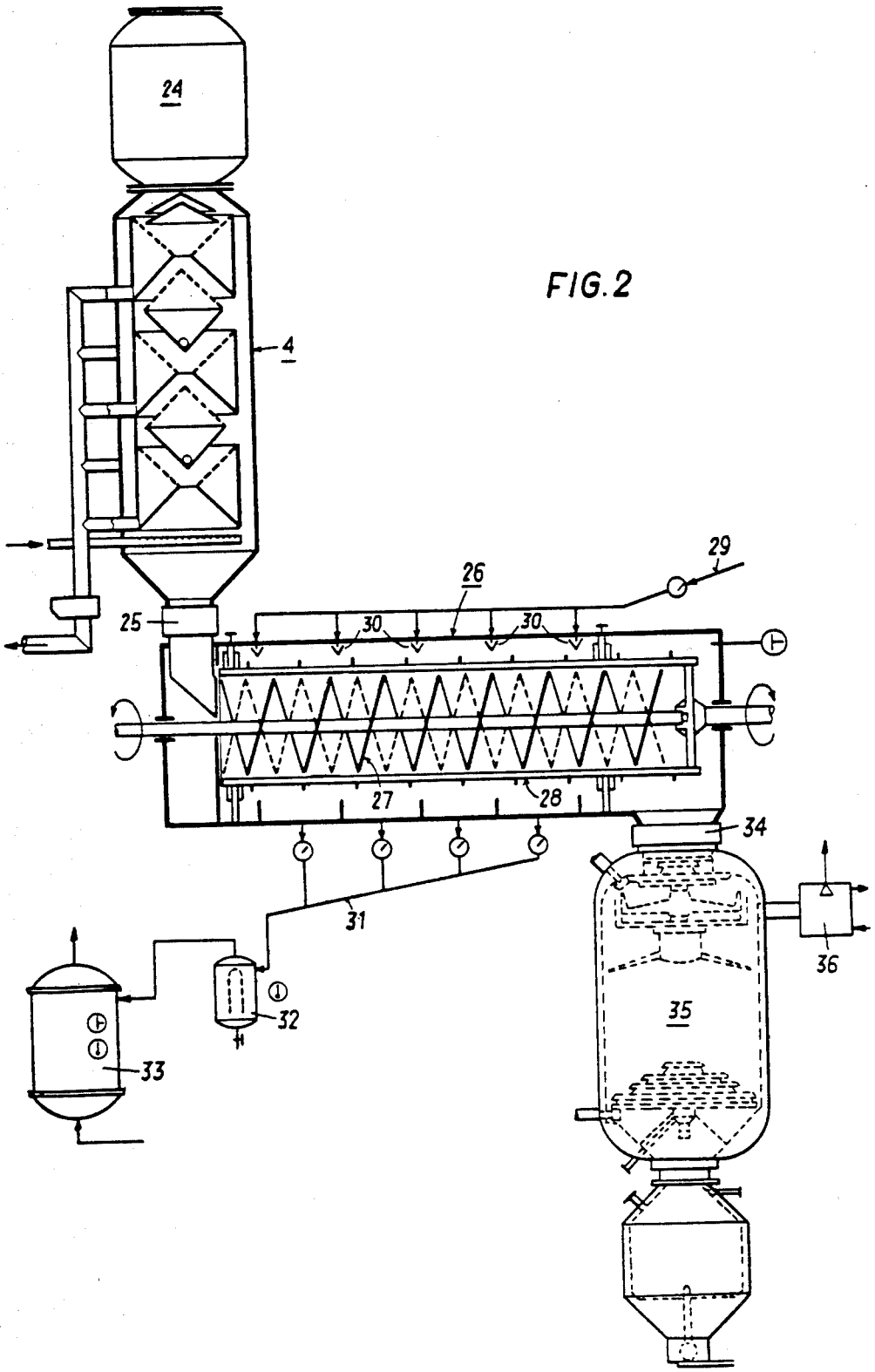

FIG. 1 shows a continuous coal drying equipment in connection with a fine coke production within a hearth furnace and FIG. 2 shows a continuous coal drying equipment in connection with a pressurized gasification equipment.

In FIG. 1 the coal charging bunker is designated 1. The coal arrives at a preheating stage 2 within which an aqueous suspension or sludge of the coal particles is produced. The sludge flows via a pump 3 into an autoclave 4 within which a cascade 5 of slotted sieves is provided, so that the water used for transporting purposes as well as the water expelled from the coal and the water formed by condensation of part of the steam can be removed from different levels via a collecting conduit 6. Steam of a steam generator 7 is introduced via nozzles 8 at the bottom of the autoclave and the pressures and the temperatures within this autoclave 4 are maintained between 5 and 45 bar and between 150° and 260° C. respectively, thereby selecting the conditions corresponding to drying with saturated steam. By continuously removing the water formed, the attack of the saturated steam on the particles to be dried is improved. $CO_2$ formed is removed via an opening 9. The dried product arrives into a centrifuge 11 via a conveying screw 10 and is still under the operating pressure of the autoclave. The water coming from the centrifuge is supplied into an upstream settling tank 12 and into an oxydator 13 and the waste heat of these aggregates can be recycled into the process via heat exchangers 14 and 15. Part of the purified waste water is sucked by means of a pump 16 and utilized for producing the suspension. In this process brown coals rich in water and having a particles size from 0 to 50 mm, preferably within selectable ranges from 0 to 10, 0 to 20, 5 to 20 mm or the like, is used. The dried particles are removed from the centrifuge 11 via a lock and brought into a container 17 for pressure-relief and steam removal, respectively, a complete pressure relief being effected within the container 17 in view of the subsequent coking step 18. The dried particles are, via a conveying screw 19, introduced into the hearth furnace 20 (Salem hearth furnace), the discharge opening for the coke being designated 21. The waste gases of this hearth furnace and representing combustible waste gases of the coking process are burnt in a subsequent combustion chamber 22 and used within a waste heat boiler 23 for producing steam for the coal drying stage. Brown coal dried in this manner according to the drying process operated with saturated steam has particularly proved as mechanically more resistant against any stress within the hearth furnace and coke produced in this manner comprises more favourable sorts of coke than coke obtained from coal dried in a drying drum. The dry coal produced by means of the continuous drying process was dried according to the requirements of the hearth furnace to a residual humidity content of 10%.

FIG. 2 shows a continuously operated coal drying stage which is analagous to that shown in FIG. 1 and which is followed by a resting bed-gasification operating under pressure. In this process, the brown coal being rich in water and having a granulometry of 0 to 80 mm is, after being preheated with waste steam or water obtained during the drying process, arriving from the charging bunker 24 into the autoclave 4 which is designed analogously to the autoclave 4 of FIG. 1. In the following, the product dried with saturated steam arrives the drying drum 26 equipped with slotted sieves either directly or via a lock 25. This drying drum has a conveying screw 27 and a slotted sieve 28 shaped according to the mantle of a cylinder, the screw and the sieve being arranged for being rotated simultaneously or one separate from the other. The drying drum 26 is arranged within a pressure-resistant housing. The drying drum 26 allows adjustment of the most favourable conditions for the subsequent gasification under pressure, and saturated steam or hot steam having the desired temperature and the desired pressure is supplied to this drying drum via a conduit 29 and nozzles 30. Waste water is supplied via a collecting conduit 31 into a sludge settling tank 32 and into an oxydator 33 prior to being partially reused for producing, after having been used for preheating the product to be dried, a suspension. The dried product from the drying drum 26 arrives, via a lock 34, a gasificator 35. The gas formed is removed at 36.

Separation of the cascade of slotted sieves within the autoclave 4 from the drying drum 26 equipped with slotted sieves by means of a sieve lock 25 is required for coals necessitating step-wise drying for maintaining their lumpiness and this on account of their structure. With these coals, there is used, after a corresponding preheating step, a pressure of the saturated steam from preferably 10 to 20 bar within the sieve cascade and a pressure of preferably 20 to 40 bar within the drum equipped with slotted sieves. The pressure within the drum equipped with slotted sieves will conveniently be maintained equal to that within the gasifier. If a subsequent upgrading stage requires lower humidity contents, the drying drum equipped with slotted sieves can, if desired, also be operated with superheated steam instead of using an atmosphere of saturated steam within the drying drum equipped with slotted sieves. Also in this case, a lock 25 is provided for effecting separation from the atmosphere of saturated steam existing within the autoclave 4.

In the following, a rough comparison is made between the heat balance of the combination of, on the one hand, the usual drying process according to Fleißner or, respectively, the continuous drying process according to Fleißner with the subsequent gasification or, respectively, coking step, based on the sensible heat of brown coal from Kosovo having a water content of 50 percent by weight (through-put capacity: 75 t raw coal per hour).

1. Non-integrated system comprising pressure-relief and cooling down.

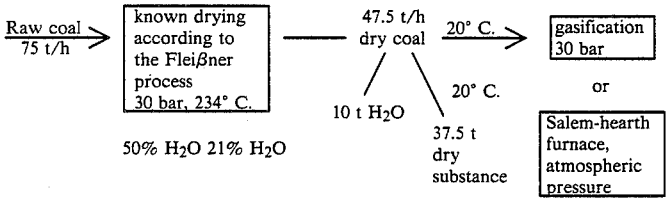

Amount of heat introduced into the gasifier (coking furnace) together with the dry coal:

| | |
|---|---|
| Water: (20–0) × 4.2 × 10 000 = | 0.840 GJ/h |
| dry substance: (20–0) × 1.45 × 37 500 = | 1.088 GJ/h |

-continued

| | |
|---|---|
| | 1.928 GJ/h |

2. Integrated system without pressure relief and without cooling down.

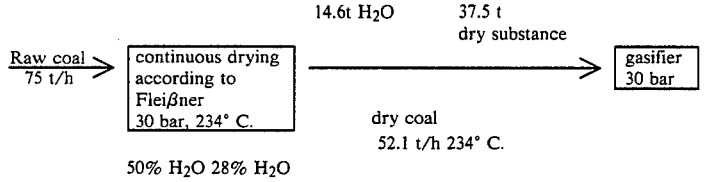

Amount of heat introduced into the gasifier with the dry coal:

| | |
|---|---|
| Water: (234–0) × 4.6 × 14 600 = | 15.715 GJ/h |
| dry substance: (234–0) × 1.45 × 37 500 = | 12.724 GJ/h |
| | 28.439 GJ/h |

3. Integrated system comprising pressure relief and partial cooling down.

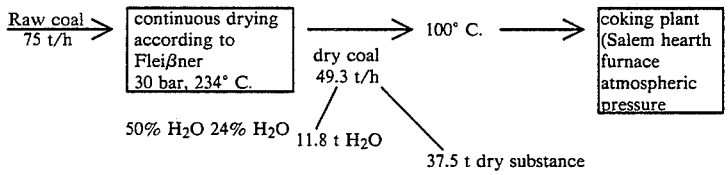

Amount of heat introduced into the Salem-hearth furnace by the dry coal:

| | |
|---|---|
| Water: (100–0) × 4.2 × 11 800 = | 4.956 GJ/h |
| dry substance: (100–0) × 1.45 × 37 500 = | 5.438 GJ/h |
| | 10.394 GJ/h |

The comparison shows that in the combined process of drying according to Fleissner and gasification, on the one hand, and drying according to Fleissner and coking, on the other hand, great quantities of heat can be saved:

| | |
|---|---|
| Dry according to Fleißner in usual manner and gasification | 1.928 GJ/h |
| Continuous drying according to Fleißner combined with gasification under pressure | 28.429 GJ/h |
| Continuous drying according to Fleißner combined with coking | 10.394 GJ/h |

What is claimed is:

1. In a process for continuously drying and upgrading of organic solid materials such as brown coals, said process being of the kind which includes preheating the solid materials, contacting the solid materials with saturated steam under a pressure of 5 to 45 bar and at temperatures of 150° to 260° C. with continuous removal of the expelled and condensed water and of the $CO_2$ formed, drying the materials by means of superheated steam in a plurality of drying stages, said process being characterized by immediately removing the materials from the last drying stage under superatmospheric pressure and introducing the materials with their sensible heat into the upgrading stage.

2. Process as in claim 1, characterized in maintaining the pressure in the last drying stage higher than or equal to the pressure within the upgrading stage.

3. Process as in claim 2, characterized in continuously and partially pressure relieving the materials between the last drying stage and charging into the upgrading stage, the pressure on charging into the upgrading stage being equal to the pressure within the upgrading stage.

4. Process as in claim 3 wherein the pressure relieving step reduces the pressure to atmospheric pressure and characterized in upgrading the materials by coking after having been pressure-relieved to atmospheric pressure.

5. Process as in claim 1, characterized in that the organic solid materials are, under the operating pressure of the last drying stage or after an intermediate pressure-relief down to a super-atmospheric pressure, upgraded by gasification, hydrogenation and liquification, respectively, or hot briquetting under pressure.

* * * * *